US006448539B2

(12) United States Patent
Ose et al.

(10) Patent No.: US 6,448,539 B2
(45) Date of Patent: Sep. 10, 2002

(54) ELECTRIC HEATING ELEMENT AND METHOD FOR ITS PRODUCTION

(75) Inventors: Lutz Ose, Sternenfels; Eugen Wilde, Freudenstein; Willi Essig, Boeblingen, all of (DE)

(73) Assignee: E.G.O. Elektro-Geraetebau GmbH (DE)

( * ) Notice: Subject to any disclaimer, the term of this patent is extended or adjusted under 35 U.S.C. 154(b) by 0 days.

(21) Appl. No.: 09/775,286

(22) Filed: Feb. 1, 2001

(30) Foreign Application Priority Data

Feb. 1, 2000 (DE) ..... 100 04 177
Feb. 1, 2000 (DE) ..... 100 04 176

(51) Int. Cl.[7] ..... H05B 3/68
(52) U.S. Cl. ..... 219/463.1; 431/239
(58) Field of Search ..... 219/463.1, 460.1, 219/543, 421, 200, 553; 164/69.1; 165/10; 427/275; 431/239; 501/129; 338/22 R; 392/488

(56) References Cited

U.S. PATENT DOCUMENTS 4,020,896 A * 5/1977 Mold et al. ..... 165/10
4,633,069 A * 12/1986 Berg et al. ..... 219/553
4,909,300 A * 3/1990 Horie ..... 164/69.1
4,973,566 A * 11/1990 Readey et al. ..... 501/129
5,073,689 A * 12/1991 Tabata et al. ..... 219/200
5,225,662 A * 7/1993 Schmidt ..... 219/421
5,451,748 A * 9/1995 Matsuzaki et al. ..... 219/543
5,511,974 A * 4/1996 Gordon et al. ..... 431/239
5,907,271 A * 5/1999 Hirano et al. ..... 338/22 R
5,963,709 A * 10/1999 Stples et al. ..... 392/488
6,043,463 A * 3/2000 Plumptre ..... 219/460.1
6,284,314 B1 * 9/2001 Kato et al. ..... 427/245
2001/0003336 A1 * 6/2001 Abbott et al. ..... 219/543

FOREIGN PATENT DOCUMENTS

JP 01289558 * 11/1989 ..... B22D/19/00
JP 09303940 * 11/1997 ..... F25D/21/08

* cited by examiner

*Primary Examiner*—Teresa Walberg
*Assistant Examiner*—Leonid M Fastovsky
(74) *Attorney, Agent, or Firm*—Akerman Senterfitt

(57) ABSTRACT

On the one hand is provided an electric heating element (15, 31) consisting of a semiconducting ceramic (28, 32) as well as a method for its production. The semiconducting ceramic material may be porous or foamed to thus contain pores (29, 34) open outwardly. The pores are attainable by admixing filler bodies, which dissolve during sintering, to the starting material or by impreganting a textile substrate material (36) with a ceramic material. Due to the porosity of the heating element (15, 31) an increased radiant surface area is attained. On the other hand is provided an electric heating element (115, 132, 145, 150, 158, 160, 162) as well as a method for its production which consists of semiconducting ceramic and comprises a negative temperature coefficient of the electrical resistance. The temperature coefficient is negative throughout over the full operating temperature range. The material suitable for the heating element (115, 132, 145, 150, 158, 160, 162) is doped silicon carbide or TiN. One such heating element (115, 132, 145, 150, 158, 160, 162) may be put to use, for example, rod-shaped in a radiant heater body (111) or foil-shaped at the underside of a surface element (30) of a cooktop (31). The electric conductivity of the material of the heating element (115, 132, 145, 150, 158, 160, 162) can be adjusted by nitrogen absorption during annealing in a nitrogen atmosphere subsequent to the sintering process.

41 Claims, 6 Drawing Sheets

ELECTRIC HEATING ELEMENT AND METHOD FOR ITS PRODUCTION

TECHNICAL FIELD AND BACKGROUND OF THE INVENTION

The invention relates to an electric heating element, more particularly for a radiant heater body of an electric range made of a semiconducting ceramic, and to a method for its production.

DE 296 19 758 U1 discloses an electric radiant heater including an electric resistance heating element comprising a changing temperature coefficient of the electrical resistance. In a first temperature range extending from 0° C. to at least 700° C. the temperature coefficient is negative. In a second temperature range following the first temperature range the temperature coefficient is required to be positive. In this way it is intended that the resistance heating element automatically adapts to the second temperature range or to automatically limit any further increase in temperature above a critical value after an initial very fast increase in temperature to red hot.

The radiant heater takes the shape of at least one elongated rod or strip, its cross-section preferably being rectangular and is supported by its narrow edge on a substrate, the resistance heating element being configured solid.

SUMMARY OF THE INVENTION

The invention is based on the object of providing a heating element as cited at the outset permitting fast heatup and good regulation and comprising in general good heating properties, particularly advantageous values for the thermal surface loading or heating radiance, as well as providing a method for the production thereof.

This object is achieved by a heating element as it reads from the features of claims 1 and 21 as well as by a method as it reads from the features of claims 12 and 25. Advantageous aspects of the invention are the subject matter of the sub-claims.

In accordance with the invention the heating element may be made, on the one hand, of a semiconducting ceramic material which is open and/or porous at least in part or mostly and which more particularly in accordance with a first preferred embodiment may be foamy or spongy, particularly preferred cavitated. Foamy in this respect is to be understood as being a type of material in which the material comprises a large number of inclusions or chambers or pores preferably void. More particularly such a foamy ceramic material has the appearance of a sponge or a foam. Considered advantageous in this respect is a material having pores open to the environment to thus avoid gas release problems and the like.

Although the porosity may be selected over a wide range, a range of 10 to 50 ppi (pores per inch) is viewed advantageous, meaning that on a one inch line through the material 10 to 50 pores are cut or swept, corresponding roughly to 1 pore per mm. Values of approx. 30 ppi are considered to be particularly advantageous, thus making the material relatively finely porous.

A further advantageous aspect is the possibility of providing the ceramic material structured and limbed in the form of branchings which may result in, for example, a skeletonized structure in which the branching members are thin as compared to the cavitations. Advantageously the heat conducting material may be configured three-dimensionally meshed, more particularly similar to a three-dimensional textile material.

To cover both embodiments by one term the expression structured (foamed or skeletonized) ceramic is used in the following.

It is of advantage when in the course of the elongation of the heating element its electrically effective cross-section remains substantially the same to thus avoid in bent heating conductors the so-called hot paths of increased current flow, especially at the inner side of a curve. This is achieved to particular advantage by the skeletonized structure as described above, the limbs of which approach each other at such inner sides without changing their length or electrically effective conductor cross-section in each case.

The specific weight of the heating element or structured ceramic in both basic aspects may be in the range 0.1 to 3 g/cm$^3$, preferably approx. 0.6 g/cm$^3$ for 30 ppi for foamed ceramic, it being obvious from this that the proportion of pores or open sections exceeds the proportion of ceramic material by far, i.e. more pores or cavitations or interspaces existing than ceramic material. A solid ceramic material has a specific weight in the range 3 to 4 g/cm$^3$. Thus the volume of the pores or cavitations or open sections may be partly ten to twenty times higher than that of the actual ceramic material. It is particularly to be noted that by employing a skeletonized ceramic the so-called porosity is even higher.

One significant advantage afforded by such a structured ceramic is that it exhibits a highly favorable ratio of conductor cross-section to radiant surface to thus permit the resulting heat to be emitted particularly well whilst achieving a very fast red hot heatup of the heating element. Advantageously a structured ceramic is configured elongated or rod-shaped.

The thermal surface loading is preferably approx. 12 W/cm$^2$ at 1,200° C. and approx. 16 W/cm$^2$ at 1,300° C., surface in this respect being, however, the envelope of the surface of the heating element, not the surface of the pure ceramic material.

The specific resistance can be in the range of approx. 0.25 Ohm*cm (cold) at around 30 ppi to approx. 0.4 Ohm*cm (at approx. 800° C.). The value of the heating capacity can be set in one example embodiment with approx. 40% by weight silicon in the range of approx. 0.68 J/gK (cold) to approx. 1.15 J/gK (at approx. 1,000° C.). Analogous to the ppi specification for the foamed structured ceramic it is the number of meshes per volume that dicates the cavitation size or density for the skeletonized version thereof.

The material of the heating element is preferably formulated with silicon, more particularly it may be formulated with silicon carbide, further alternatives being SiSiC, RbSiC as well as SiN whereby aluminum oxide, zirconium oxide or AlN may be used instead of silicon. A material formulated with silicon may also be $MoSi_2$ commercially available as "kanthal super", admixed to advantage with one of the aforementioned ceramics. Preferably the material of the heating element or this itself is sintered, The surface of the material may be coated with silicon oxide for surface protection, preferance being given particularly to silicon carbide doped with nitrogen or as an alternative reaction-bound silicon carbide to advantage. These procedures may take place to advantage in a reactive gas atmosphere.

The heating element may be formulated to advantage with Ti or TiN which is more particularly the electrically active material. The Ti material is coated on the outside to advantage with a protective coating which may be an oxide coating, for example SiO or $Al_2O_3$. Due to the mechanical properties of the compound or TiN it is preferably applied to a substrate, the material of which may be $Al_2O_3$ since this exhibits a similar thermal coefficient of expansion. A substrate or substrate matrix may be configured as described above, for example, skeletonized or foamed. As an alternative the heating element may be fabricated in a sandwich configuration in which the heating layer of TiN is applied to a substrate which is then covered by a protective coating. Such a sandwich-type heating element is configured preferably flat, for example as a flat rod incorporating a plurality of limbs, where necessary.

Another preferred alternative is to admix the TiN with matrix material, for example $Al_2O_3$, lending itself to good sintering. The specific electrical resistance of the mix depends on the volume percentage of the TiN which should, however, exceed 15%, although percentages as high as 50% or even 60% are still possible, also as regards workability. Such TiN admixed ceramic mixtures likewise require a protective coating, for example $Al_2O_3$.

Another alternative provides for a foamed or skeletonized structured material comprising a siliconized coating. One such structured ceramic, especially of SiC comprises a highly favorable conductor cross-section to surface ratio.

The heating element may be configured elongated, more particularly with at least one rod-shaped section extending, for example, transversely over a heating zone of a radiant heater body of an electric range, another alternative being a zig-zag or meander configuration of an elongated heating element for covering a larger surface area or bordering it. Alternative shapes of the heating element include a sheet configuration, for example in the form of a thin foil or the like.

For mechanical reinforcement the heating element may be fiber-reinforced, for which ceramic fibers, for example, are suitable and which may be inserted in the starting material prior to it being sintered into the ceramic.

The value for the specific weight of a structured ceramic may be selected less than approx. 5 g/kW down to approx. 1.7 g/kW to advantage.

It is via the porosity of the foamed ceramic and its pore size and number or mesh size of a skeletonized structured ceramic that the effective cross-section and/or the electrical resistance of the heating element can be set, the more or larger the pores or meshes the greater is the surface per mass unit and thus the radiance although the limiting factors in this respect are the ruggedness of and volume taken up by the heating element.

In addition the heating element may be treated, especially by doping or silicon infiltration, such that its temperature coefficient of the electrical resistance, particularly as viewed over the operating temperature range, does not change in sign. The operating temperature range may far exceed 1,000° C., for example as high as 1,300° C. or even max 1,600° C. It is within this operating temperature range that the temperature coefficient should not change in sign to achieve a heating conductor which is defined with good control of the heatup characteristic. This may be, for example, a PTC characteristic, i.e. the electrical resistance increasing with increasing temperature, the heating element then automatically attentuating itself on heatup. In this arrangement the profile of the temperature coefficient may vary as a function of the temperature in each case, it not rising significantly until high temperatures are attained in avoiding overheating.

In the method in accordance with the invention for producing an electric heating element consisting of a semiconducting ceramic the starting material of the ceramic is admixed with a non-ceramic filler, the filler material being either insulating or incinerated in the sintering process to thus form the insulating interspaces, preferably cavitations, in the ceramic in subsequent sintering thereof.

In producing, for example, a foamed ceramic as described above the starting material is admixed with filler bodies having an insulating effect or other effect due to the change in temperature. The filler bodies are homogenously admixed with the starting material and may dissolve due to the thermal exposure in subsequent sintering in leaving the pores behind, it being in this way that the pores as cited above materialize as interspaces insulating the ceramic in sintering the starting material into the ceramic.

One material dissolving with increase in temperature is preferably a plastics material, for example, small balls of expanded polystyrene or the like. The size of the balls corresponds substantially to the desired pore size, their proportion the desired porosity.

Substantially the filler bodies can be admixed homogenously with the starting material, although it is also possible to add fewer or smaller filler bodies in configuring sections mechanically reinforced and/or thermally less stressed in these portions requiring a certain expense in filling the mold for the heating element. It is just as feasible, however, to compact the ceramic/filler mix in sections of less porosity with the addition of further ceramic material which is possible with no problem by elastic filler bodies (resulting in smaller pores).

Another alternative is to foam the ceramic starting material similar to the procedure in producing foamed plastics or the like. For this purpose a suitable binder can be admixed, such structures being finished with a subsequent coating of TiN and a protecting coating.

For producing a skeletonized structured ceramic as described above a textile material configured three-dimensionally and intermeshed may be impregnated with the fluid starting material for the ceramic. In this arrangement the starting material envelops the individual threads or skeleton limbs of the textile material in thus producing its structure. The textile material can thus form a kind of substrate for the ceramic. After impregnation the green body in which the starting material is preferably somewhat dried, is then baked causing the textile material to disappear or incinerate leaving the ceramic material behind, i.e. substantially in the form of the textile material including the branchings as a structured ceramic. The insulating interspaces correspond substantially to the mesh size of the textile material. Employed to advantage as the textile material is a fabric formed of knotted threads of considerable thickness or three-dimensionally or spatial extent. As an alternative several interconnected plies of a fabric may be employed. It is just as possible to make use of other forms of open substrates forming the pores or mesh. As a further example use may be made of an open pore foamed plastic in which the ceramic branchings exist less as skeletonized limbs but more in the form of of thin chamber walls or the like. Here too, a subsequent TiN or protecting coating may be applied.

Production may further include reforming the textile material which, on the one hand, may be done prior to impregnation with the ceramic material, or on the other preferably after impregnation in corresponding to the heating element as later desired.

For attenuating a temperature coefficient of the ceramic material the semiconducting ceramic may be doped with a dopant, use being made to advantage for this purpose, for example, of the porosity or openness for diffusing the gaseous dopant and accordingly for doping.

In the ceramic starting material, preferably existing fluid, a binder may be contained, more particularly to permit subsequent mixing with filler bodies or for wetting or impregnating the textile material.

As another alternative the ceramic after sintering may be subsequently annealed in an atmosphere containing the dopant. Doping may be done preferably with nitrogen which is diffused from the subsequent annealing atmosphere into the ceramic via the pores, the nitrogen absorbed by the ceramic being set via the duration of subsequent annealing or via the percentage of nitrogen in the atmosphere. When a ceramic is involved whose electrical conductivity or temperature coefficient can be influenced by the nitrogen absorbed, advantageous and desired properties of the ceramic can be set, this permitting in particular achieving an aforementioned temperature coefficient with no change in sign over the operating temperature range. Subsequent annealing may be done, for example, at temperatures of around 2,200° C.

Furthermore in accordance with the invention an electric heating means including a heating element as described above may be provided, the heating means comprising a temperature sentinel assigned to the heating element including control means for influencing the heating element.

In accordance with the invention the heating element may further exhibit a negative temperature coefficient of its electrical resistance, this temperature coefficient being negative preferably over a broad temperature range covering or even exceeding, for example, the usual operating temperature of a heater. Since a temperature seriously exceeding the operating temperature of such a heater is to be avoided, where possible, it is the response substantially within this range that counts. The maximum operating temperature of the heating element lies way above 1,000° C., for example 1,300° C., preferably maximum 1,600° C., more particularly just below the latter. Within the operating temperature range the temperature coefficient should not become positive in accordance with the invention, it preferably always remaining negative.

The advantage of the temperature coefficient being negative throughout lies not only in the faster increase to a red hot temperature and thus shorter heatup phase, since there is no "delay" in attaining higher temperatures of the heating element, but also in the fact that although soft starting is provided, the current is then able to rapidly increase in prompting any further heating means cooperating with the heating element in accordance with the invention to produce a higher heat output. For regulating an "ultrafast" heating element in accordance with the invention a temperature sentinel needs to be provided to prevent the heating element from exceeding the operating temperature range or a maximum temperature, the temperature sentinel being configured to advantage for ultrafast reaction. In all, this thus enables a heating means to be provided of ultrafast response and effect which due to the essential linear response of the heating element permits good regulation.

The material of the heating element is preferably formulated with silicon, more particularly it may be formulated with silicon carbide, further alternatives being SiSiC, RbSiC as well as SiN whereby aluminum oxide, zirconium oxide or AlN may be used instead of silicon. One siliconized material may also be $MoSi_2$ commercially available as "kanthal super". Preferably the material of the heating element or this itself is sintered. The surface of the material may be coated with silicon oxide for surface protection.

Preference is given particularly to silicon carbide doped with nitrogen or as an alternative reaction-bound silicon carbide to advantage.

A further preferred material is TiN as regards which reference is made to the comments above.

The heating element may be configured elongated, more particularly with at least one rod-shaped section extending, for example, transversely over a heating zone of a radiant heater body of an electric range, another alternative being a zig-zag or meander configuration of an elongated heating element for covering a larger surface area or bordering it.

Alternative shapes of the heating element include a sheet configuration, for example, in the form of a thin foil or the like.

For mechanical reinforcement the heating element may be fiber-reinforced, for which ceramic fibers, for example, are suitable and which may be inserted in the starting material prior to it being sintered into the ceramic.

The value for the surface loading of the heating element in one preferred embodiment is approx. 11.8 $W/cm^2$ at around 1,200° C. and approx. 16 $W/cm^2$ at around 1,300° C.

Also provided in accordance with the invention is a method of producing an electric heating element including an inherently negative temperature coefficient of the electrical resistance of the heating element, the heating element being configured more particularly in accordance with one of the alternatives as described above. In accordance with the invention the heating element is made of a semiconducting ceramic doped with a dopant to attenuate the negative temperature coefficient, nanoparticles being contained in the starting material permitting adjustment of the residual porosity of the ceramic after the starting material has been sintered. The residual porosity serves diffusion of a gaseous dopant and thus doping of the material with a dopant.

More particularly, the starting material can be compacted, preferably non-pressurized down to a relative density of 80% to 95%, more particularly approx. 90%. In the starting material which may be provided powdered a binder may already be contained. In subsequent sintering the porosity of the ceramic materializes due to the nanoparticles for which nanoscale carbon and/or submicron boron carbide may be admixed, for example, as sinter additives, the quantity of which thus permits adjusting the degree of porosity of the ceramic as regards both density and size of the pores.

After sintering the ceramic is preferably subsequently annealed in an atmosphere containing the dopant, preferably done with nitrogen. In this arrangement the dopant is able to diffuse from the atmosphere into the ceramic, more particularly into the existing pores. How much nitrogen is absorbed by the ceramic can be set via the duration of subsequent annealing. Since the amount of nitrogen absorbed by the ceramic influences the electric conductivity or temperature coefficient the advantageous properties as cited above as regards the temperature coefficient of the ceramic can be set. Subsequent annealing may take place for example at temperatures of around 2,200° C.

Furthermore, an electric heating means including a heating element as described above can be provided, the heating means including a temperature sentinel assigned to the heating element with ceramic material for influencing the heating element. The heating means comprises preferably so-called radiant heater bodies under a cooktop, made of vitrified ceramic, for example.

These and further features read not only from the claims but also from the description and the drawings. Each of the individual features is achieved by itself or severally in the form of sub-combinations in one embodiment of the invention and in other fields and may represent advantageous aspects as well as being patentable in its own right, for which protection is sought in the present. Sectioning the application including sub-titling does not restrict the general validity of the comments made thereunder.

BRIEF DESCRIPTION OF THE DRAWINGS

Example embodiments of the invention are explained in more detail in the following and illustrated in the drawings in which.

DETAILED DESCRIPTION OF THE EXAMPLE EMBODIMENTS

Figure 1:
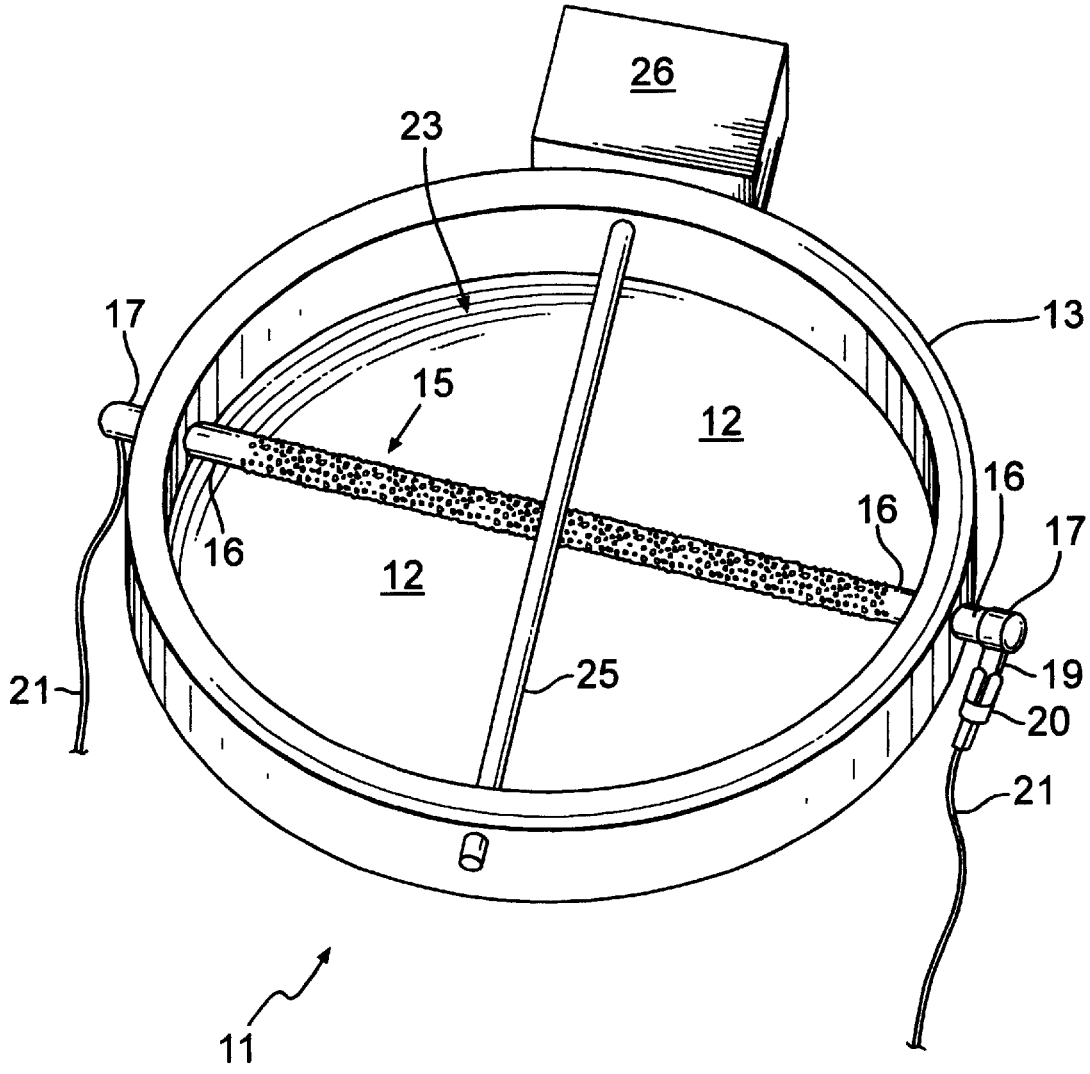
FIG. 1 is a slanting view of a porous heating element in accordance with the invention arranged as a heater bar in an insulator.

Referring now to FIG. 1 there is illustrated diagrammatically in a slanting view a radiant heater body 11 consisting of a dished insulator substrate 12 and a tubular insulating rim 13. Substrate 12 and rim 13 may be arranged, where necessary, in a supporting dish or the like, for example of thin sheetmetal.

Applied to the insulator substrate 12 is a heating element 15 in accordance with the invention forming the diameter of the round radiant heater body 11. The heating element 15 is illustrated rod-shaped, whereby of course, deviations from this shape may be provided. In addition, the heating element 15 is illustrated in this arrangement alone solely for a better overview, i.e. it being possible to advantage to provide further heating means. Further heating means could be, for example, further heating rods such as the heating element 15, or as an alternative thereto other radiant heater bodies such as radiant heater bands or bright radiators, e.g. halogen lamps. In such combined heating arrangements the heating element 15 serves among other things, due to its very good, i.e. very brief red hot delay, to signal that the surface element is in operation and permitting very fast boiling. Further heating means may provide a heat output distributed over the round surface area of the radiant heater body 11 as well as being devised for simmering. Instead of a straight rod curved shapes are also possible, for example S-shaped. The cross-section must not necessarily be round as shown in FIG. 1, flat and/or rectangular cross-sections also being alternatives.

Electrically terminating the heating element 15 is done at the ends by means of metal terminal caps 17 guided via terminal sections 16 of the heating element to which they are connected both mechanically and electrically. As is clearly evident, the terminal sections 16 comprise no porosity in the example as shown. This is made possible by making the heating element 15 of a starting material provided with or without filler bodies. The starting material without filler bodies is used to configure the ends of the heating element 15 or terminal sections 16. Such a configuration of the ends or terminal sections of the heating element 15 has the purpose of considerably reducing the electrical resistance at these sections to avoid them being overheated since they ultimately outwardly penetrate the insulation of the radiant heater body 11. In addition this would otherwise make it difficult to make the electric connection thereto at high temperatures.

The terminal caps 17 comprise protruding terminal tags 19 for mounting the terminal lugs 20 which in turn comprise power leads 21 connecting the power supply of the heating element 15. As an alternative to such terminal caps 17 the leads or tags may be directly applied to the heating element 15 or terminal sections 16, for example, by ceramic brazing.

Instead of enhancing the conductivity by leaving out the fillers or by more material thickness in the terminal sections 16 this may also be achieved by various doping or admixing the ceramic material of the heating element 15, this also enhancing the inflow of current into the porous heating part of the heating element 15.

Running above the surface area covered by the heating rods 15, i.e. in the region of a heating zone 23 thus formed, is a rod-shaped sensor 25 of a temperature sentinel 26 of a known kind. The temperature sentinel 26 is arranged at the outer side of the insulating rim 13. As soon as a critical adjustment temperature is exceeded in the heating zone 23 the temperature sentinel 26 signals via the heating element 15 the power supply of the heating element 15 OFF or at least reduces it in part to thus permit regulating the temperature of the radiant heater body 11 or in avoiding overheating. Other alternatives are temperature sensors connected to a variable, preferably electronic control for the power supply to the radiant heater body 11 in thus implementing automatic cooking programs or the like. Since the heating element 15 in accordance with the invention is ultrafast in attaining high temperatures to advantage, the temperature sentinel 26 needs to instantaneously "see" any overtemperature in signalling the heating element 15 OFF. By arranging several heating means or heating elements 15, where necessary in conjunction with other heating means, it is possible with such a radiant heater body 11 to switch off part of the heating means once a critical temperature, more particularly a maximum temperature, is achieved, further heating then being possible, for example, with only some or a group of heating means.

When insulator substrate 12 and insulating rim 13 are arranged in a metal support or the like, due care is needed in satisfying safe insulation between the electric terminals for the heating element 15 and the metal support. Important in the case of such a radiant heater body 11 is a very good thermal insulation, especially as regards insulator substrate 12. For this purpose laminated insulating materials are of advantage including, for example, insulating materials which, on the one hand, are rugged and, on the other, less rugged but with better insulating properties. Another alternative is providing a reflector shield below the heating element 15 required to keep away part of the heat radiated downwards from the insulator substrate 12 whilst reflecting the heat upwards into the heating zone 23. One such reflector shield may be configured by known ways and means, preferably of metal, placed to advantage directly on the insulator substrate 12. For insulating the radiant heater body 11 the usual materials as well as a filled metal foil vacuum insulation may be employed.

Due to the very high operating temperatures of the ceramic heating elements novel thermal insulating systems may be put to use, possibly multilayer systems, on the one hand, including an under insulation formulated commercially available with an additional high-temperature layer facing the heating element. Other alternatives are compacts produced in a single operation differing in percentage formulation and materials as well as a coating of ceramic material having a corresponding sinter point or a flame or plasma coating of ceramic, a reflector shield e.g. of die-cast $Al_2O_3$ foil being yet another alternative.

Figure 2:
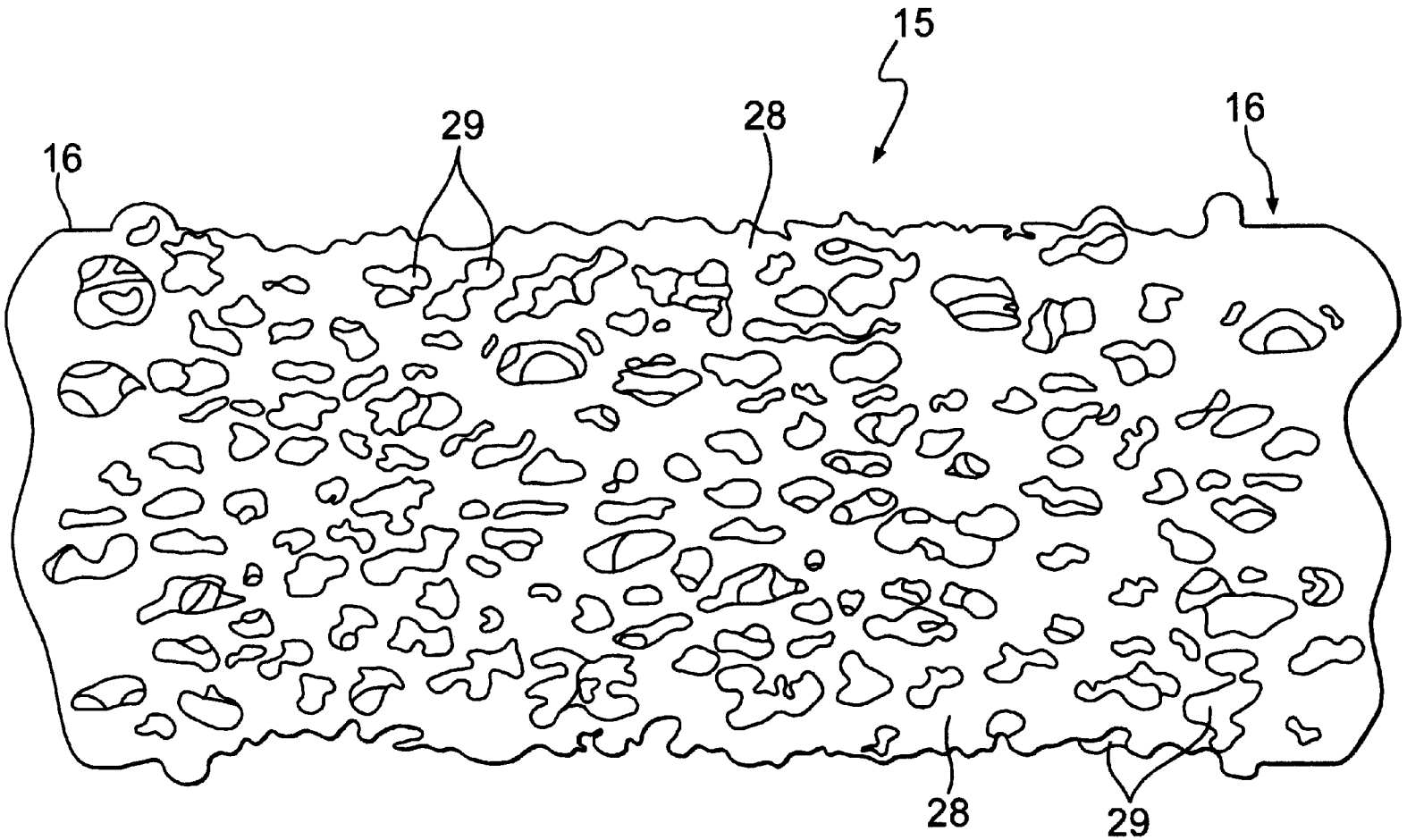
FIG. 2 is a magnified detail of a rod-shaped heating element made of foamed ceramic.

Referring now to FIG. 2 there is illustrated a heating element 15 which as a magnified view of the heating element as shown in FIG. 1 is made of a foamed ceramic, it being evident that the actual ceramic body 28 incorporates pores 29, the size of which varies but in a relatively tight range on a statistical average. Important especially in this respect is that pore size and mean wall thickness of the ceramic exhibits the desired value on an average. The porosity may be between 80% and 95%, i.e. very high. To restrict the electrical resistance important for operation as a heating element to a specific area spatially, namely excepting the side terminal sections 16 at the end, doping may be done particularly in this area. The terminal sections 16 indicated at the edge of the heating element 15 serve more particularly for support and to introduce the current into the heating element, the portion inbetween being that effective as the heater.

Figure 3:
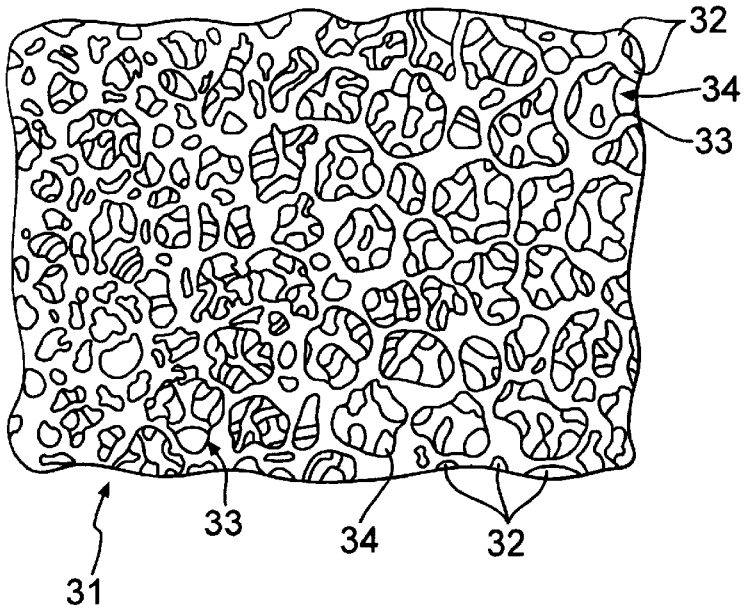
FIG. 3 is a magnified detail of a skeletonized structured ceramic.

Referring now to FIG. 3 there is illustrated a detail of a heating element 31 consisting of a ceramic body having a skeletonized structure which in this case is achieved by textile substrate material. This structure consists of limbs 32 forming meshes 33. These meshes 33 in turn contain interspaces 34 corresponding to the non-conductive portions or the pores 29 as shown in FIG. 2. It is to be noted that no limb 32 ends in nothing, instead each being connected to the other in forming the meshes 33 (except when the ceramic body is damaged).

In this arrangement it is evident that the size of the meshes 33 varies, this being due to the fact that a textile substrate material has been used in production which fails to comprise an absolutely consistent mesh size. This variation in mesh size should be within in an acceptable range.

Figure 4:
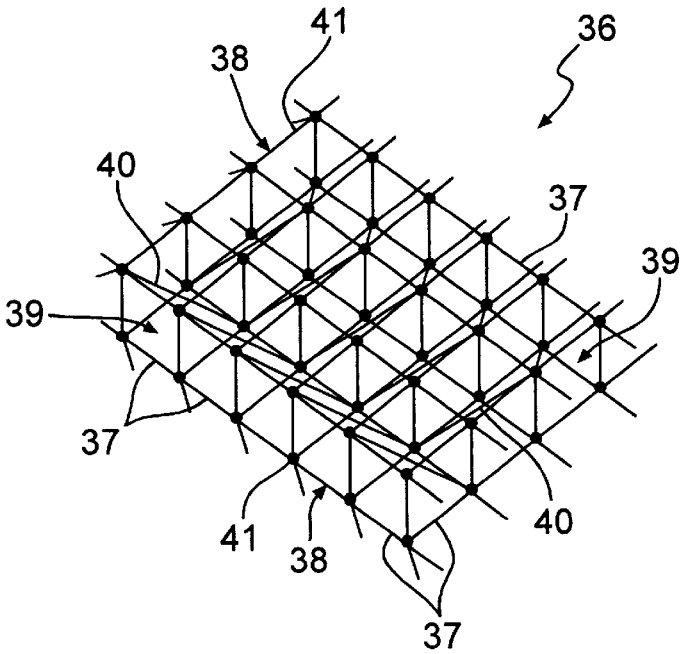
FIG. 4 is a diagrammatic illustration of a rigidly oriented structure of a textile substrate material.

Referring now to FIG. 4 there is illustrated diagrammatically an alternative configuration of a textile substrate material 36 for a ceramic body. Here, unlike the situation as shown in FIG. 3, a strictly uniform geometry has been selected for the structure in which substantially rectangular meshes 38 are formed by the individual mesh parts 37 for the basic lattice arrangement. The size of the meshes may be in the millimeter range and extent up to 10 or 15 mm.

These rectangular meshes 38 form in turn cuboidal cells 39 from the series arrangement of which the three-dimensionally expanse of the substrate material is formed. Running within the cells 39 is at least one inclined strut 40 to enhance the strength of the finished ceramic body. This strut 40 may run in a direction, for example, as dictated for mechanical strength although it may just as well be oriented to the later direction of current flow or optimal heat radiation. At the nodes the individual mesh pieces 37 of the substrate material 36 are interconnected by looping or a knot 41. This configuration as shown in FIG. 4 is substantially similar to several plies of interconnected nets thus permitting an actual matted formation serving as the substrate material.

The finished textile body is impregnated with the fluid starting material for the ceramic and after baking the resulting ceramic body exhibits the structure of the textile material.

The selected structure is merely an example in theory intended to illustrated how a structure of strictly uniform geometry is possible. The limbs could be far more numerous and also bridge more cells. An additional alternative is to configure hexagon meshes like a honeycomb, as well as highly complex mesh and cellular shapes. It is good practice when all mesh pieces and limbs develop the same amount of heat in operation, for the purpose of which the thickness and length should remain roughly the same. When, for example, the length is varied this may be compensated in turn by a suitable change in thickness so that the electrical resistance of each mesh part is the same.

This is one of the salient advantages afforded by making use of a textile substrate material, it being possible in employing modern automatic weavers to define the substrate structure right from the start, for example, extremly oriented, depending on the intended purpose or properties desired. Polymer or natural materials are examples of suitable textile materials.

To produce a ceramic material of silicon carbide as described the starting point is powdered submicron silicon carbide. Nanoscale carbon and submicron boron carbide are used as sinter additives. Silicon carbide powder is homogenously mixed via colloidal processing with nanoscale carbon and boron carbide and worked into fluid suspensions. Further conditioning these suspensions depends on the nature of subsequent molding methods (working into foil die-casting masses, directly application of slicker casting, spray-drying into a compact powder, impregnating the textile substrate materials). To produce the electrically conductive silicon carbide qualities the green bodies are non-compressively compacted defined to a relatively density of 89–91% in a flow of argon, after which they are sintered.

Compacting the green body for a foamed material may also be implemented stepwise differingly for a heating element 15, for example, more strongly in the end portions in producing the terminal sections 16. Any reduction in size of the filler bodies, especially in the case of balls of expanded polystyrene, with a reduction in pore size in compacting can be counteracted by making use of more solid filler body materials or larger filler bodies.

Although heating elements of structured ceramic preferably find application, rod-shaped or curved, sheet-type heating bodies are also just as possible, a heating element also being configured thus as a flat heating plate. This is especially possible in applications in which heating radiance is required not only in one main direction but in several directions or simply outwardly into the environment. A further application of such open-pore structured ceramics is within liquid or gaseous media which flow through the structured ceramic also best.

Figure 5:
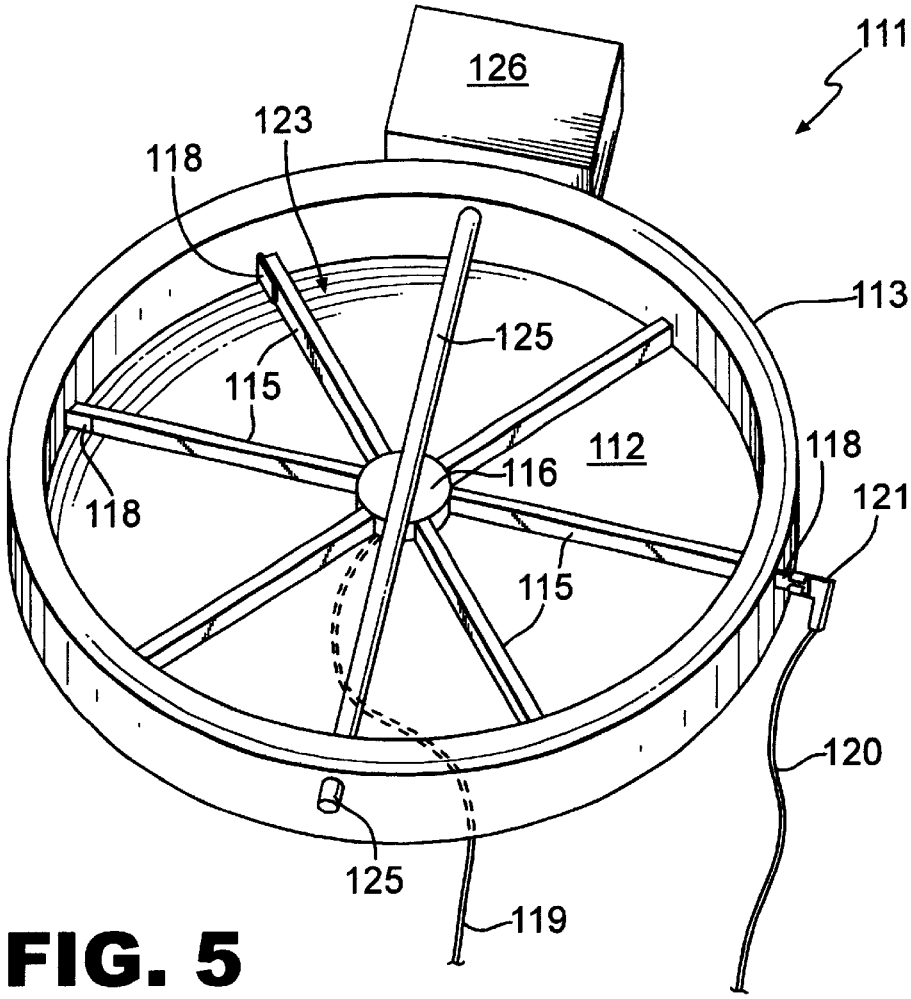
FIG. 5 is a slanting view of a heating element in accordance with the invention arranged spoked in an insulator.

Referring now to FIG. 5 there is illustrated diagrammatically in a slanting view a radiant heating body 111 consisting of a dished insulating substrate 112 including a tubular insulating edge 113. Insulating substrate 112 and insulating edge 113 may be arranged, where necessary, in a supporting dish or the like, for example, of thin sheetmetal.

Provided on the insulating substrate 112 is a spoked arrangement of heating rods 115 centered in a hub 116. The heating rods 115 consist of rectangular section long bars arranged upended, made of semiconducting ceramic material, for example, doped silicon carbon. The electric terminals are formed by the ends of the heating rods 115, i.e. as shown in FIG. 5 via the central hub 116, on the one hand, and via a terminal tag 118 on the other. Through corresponding openings in the insulating edge 113 and insulating body 112 resp. the terminal tags 118 protrude outwardly. The terminal tags 118 may be made of metal, for example, and secured by means of a ceramic brazed joint to the heating rods 115 for the electrical connection. From the hub 116 a power lead 119 protrudes. Connected to the heating rods 115 pointing to the right is a power lead 120 including a connector socket 121 clasping the terminal tags 118, all heater rods 115 featuring power leads and connector sockets of this kind, the entirety of which is not shown, however, to make for an uncluttered overview.

The heating rods 115 may consist of a substantially homogenous material. The connection to the live hub of metal may be made, for example, via ceramic brazed joints or the like. In a further aspect of the invention it is possible to render the heating rod 115 more conductive by modifying its material, more particularly by doping the ends differingly to the hub of the heating rods 115 to make for an improved connection or better inflow of current.

Above the surface area covered by the heating rods 115, i.e. in the region of a heating zone 123 formed in this way, a rod-shaped sensor 125 of a known temperature sensor 126 extends, arranged at the outer side of the insulating edge 113. As soon as a critical adjustment temperature in the heating zone 123 is exceeded the temperature sensor 126 signals the power supply of the heating rods 115 OFF or at least reduces the power to thus regulate the temperature of the radiant heater body or to prevent overheating—see also the description as regards FIG. 1.

Figure 6:
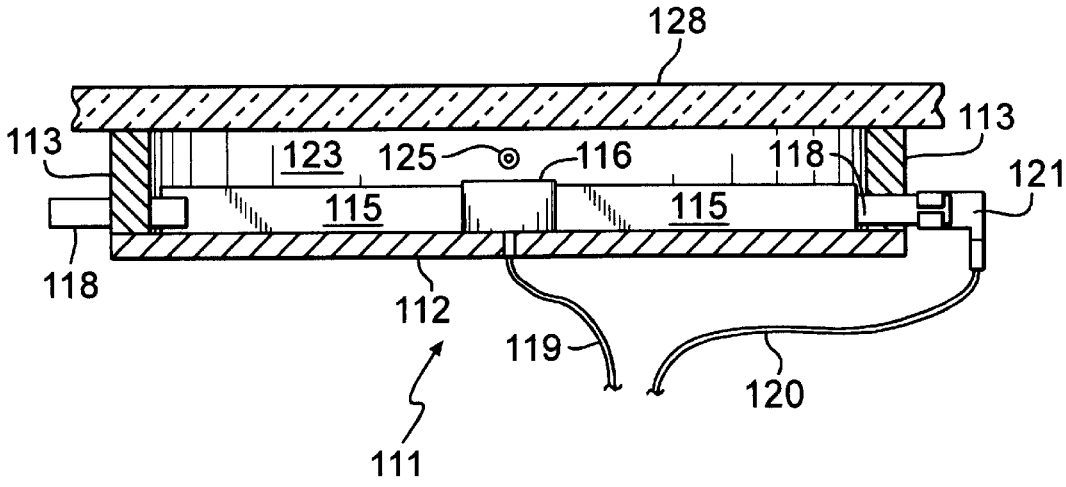
FIG. 6 is a vertical section through a radiant heater similar to that as shown in FIG. 5.

Referring now to FIG. 6 there is illustrated a vertical section through a radiant heating body 111, similar to that as shown in FIG. 5, whereby the section plane is oriented substantially perpendicular to the sensor 125. Clearly evident is how the heating rods 115 centered in the hub 116 form the diameters or radii of the insulating substrate 112. The hub 116 may also be made as a separate component into which the heating rods 115 are inserted, fixed in place and electrically contacted, it comprising a power lead 119 passing through an opening in the insulating substrate downwards. It is this star-shaped arrangement of several heating rods 115 similar to that as shown in FIG. 5 that permits achieving a relatively homogenous heating of the heating zone 123. Located thereabove as shown in FIG. 6 is a vitrified ceramic plate 128 of a cooktop heated from underneath by means of the radiant heating body 111.

Evident on the left in FIG. 66 is how a non-terminated terminal tag 118 protrudes beyond the insulating edge 113. Shown on the right in FIG. 6 is one such terminal tag 118 terminated by a terminal lug 121 including the power lead 120. Via the power leads 119 and 129 the heating rod as shown on the right in FIG. 6 can be applied to the operating voltage, more particularly, line voltage for operation.

Figure 7:
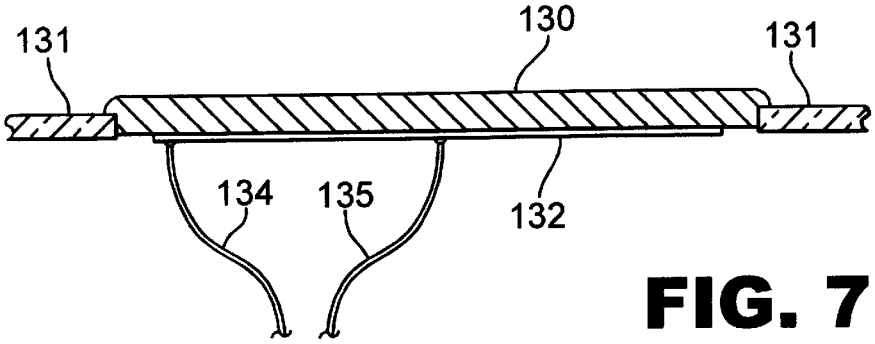
FIG. 7 is a section through a ceramic surface element including a foil-type heating element in accordance with the invention.

Referring now to FIG. 7 there is illustrated as an advantageous alternative aspect of the invention a surface element 130 inserted in an opening of a cooktop 131. Applied to the underside of the surface element 130 is a flat sheet-type heating means 132 made of a semiconducting ceramic material, preferably doped silicon carbon. The heating means 132 may be configured as a kind of thin material, substantially a flat material similar to a foil, the thickness of which may be a few millimeters down to less than one millimeter. Its shape may be configured like that of known such heating means, for example, thick-film heating means corresponding, for example, to that of a star-shaped or spoked arrangement similar to a wheel. Also possible are meander configurations or the like. For the electrical connection two power leads 134 and 135 are provided, leading to the power supply, preferably line voltage.

Since the heating means 132 is live, more particularly at line voltage, the surface element 130 needs to be made of an insulating material or comprise such an insulant. One alternative is to apply a ceramic insulating layer to its underside at which the heating means 132 is applied. A second, preferred alternative provides for making the surface element 130 likewise of a ceramic material which needs to be rendered insulating, however. One such ceramic surface element is disclosed for example by EP 0 853 444, the contents of which in making direct reference thereto belongs to the contents of the present description.

In the heating means 132 too, a temperature sentinel should be provided, for example, at the underside of the surface element 130 or as a temperature sensor directly applied to the heating means 132 which may preferably be mechanical expansion switches or electronically signalled thermoelements.

Figure 8:
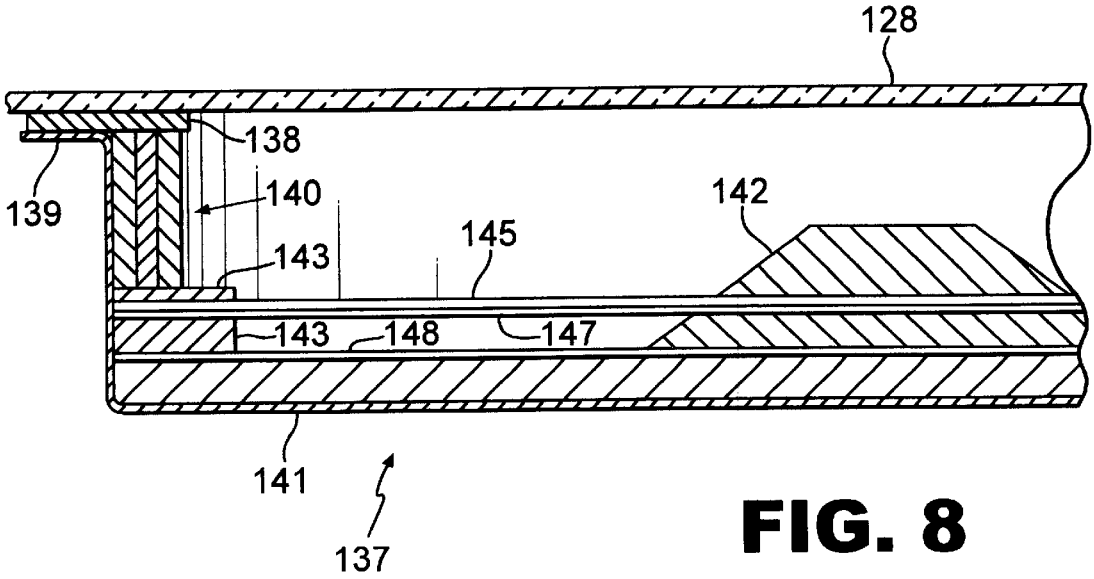
FIG. 8 is a vertical section through an alternative radiant heater body.

Referring now to FIG. 8 there is illustrated a section through a further radiant heating body 137, under the vitrified ceramic disk 128 of which the radiant heating body 137 is urged in place by means of an insulating mask 138. It consists of a sheetmetal dish 139 lined by a multilayer insulating rim 140 and an insulating floor 141. Protruding from the middle of the insulating floor 141 is a domed hold-down 142 at which a temperature sensor (not shown) similar to that as shown in FIG. 5 may be located.

Via spacer rings 143 a flat ceramic heating element 145 is arranged spaced away from the insulating floor 141. The section drawing makes it evident how the heating element 145 surrounds the domed hold-down 142 without penetrating it. Arranged directly underneath the heating element 145 sheet is a reflector shield 147 similarly shaped for shielding part of the heat radiated downwards from the insulator as well as reflecting it in part upwards. Such a reflector shield 147 is configured by known ways and means. A further reflector shield 148 is directly placed on the insulating floor 141. For insulation the usual materials as well as a vacuum insulation of metal foils including a filling come into consideration.

The heating element 145 has preferably the shape of a circular ring, through the middle opening of which the domed hold-down 142 protrudes. More particularly the shape may be based on that of a circular ring, openings made depending on the type of the contacting involved being intended to ensure uniform current flow through the active parts of the heating element 145.

Figure 9:
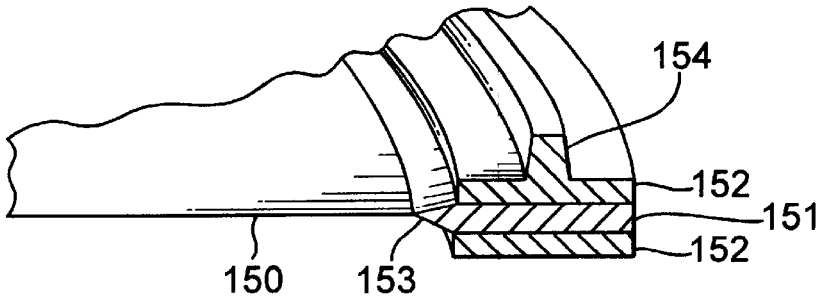
FIG. 9 is a slanting view of a heating element including a molded rim and spacer and FIG. 10 is a variant of the radiant heater body as shown in FIG. 5 including various heating elements.

Referring now to FIG. 9 there is illustrated a heating element 150 configured integrally with outer ring 151 and frame rings 152. Heating element 150 and outer ring 151 may be made from a wafer of ceramic starting material or a green body by embossing, the frame rings 152 between the flat part serving as the heating element 150 and the thicker outer ring 151 being required to be relatively short. In this arrangement the heating element 150 is, as regards its thickness, comparable to a thick foil or the like and may form either a substantially closed disk or be provided with openings.

The spacer ring 152 shown at the top in FIG. 9 and located at the bottom when fitted comprises a protuberance 154. By means of this circumferential protuberance 154 the heating element 150 can be maintained spaced away from an insulation located therebelow to thus enable higher temperatures to be attained.

In the semifinished condition or as green bodies heating element 150 or outer ring 151 and spacer rings 152 can be compacted into a solid unit, subsequent baking further consolidating the connection. The result is a heating unit in a rugged assembly frame. Since the outer ring 151 may be used to advantage for contacting the heating element 150 the non-conductive spacer rings 152 form in addition an electric insulation in the edge portion.

Figure 10:
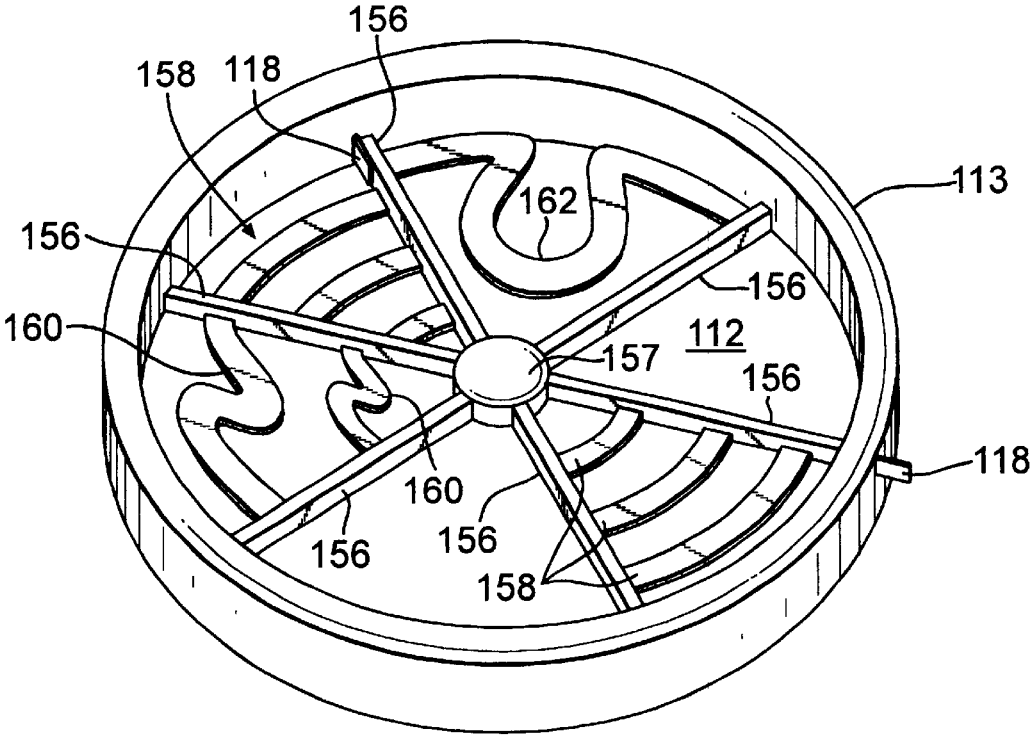

Referring now to FIG. 10 there is illustrated a modification of the radiant heater body as shown in FIG. 5 with a wealth of alternatives for configuring the heating elements, each of the spokes 156 permitting connection alternatively opposite in polarity similar to the arrangement as shown in FIG. 5 via terminal tags 118 protruding outwardly. The six spokes 156 are centered by the insulating domed hub 157 resting on the insulating bottom 112 and may be made of metal or of the same ceramic.

Shown as a first alternative are heating elements 158 in the shape of circular ring segments configured narrower towards the middle due to the reduction in length for maintaining the electrical resistance constant.

Another alternative consists of two heating elements 160 bent S-shaped, here too the outer one being wider for maintaining the electrical resistance constant. For the same material, however, the thickness of the heating elements 160 is more than than that of a heating element 158 since they are longer. A third alternative is a horseshoe-shaped heating element 162, bulging inwards to exploit the surface area between two spokes 156. Further shapes of the heating elements are, of course, possible. Cutting out the shape of the heating conductor is done either by stamping in the unbaked green condition or by laser cutting or the like in the sintered condition.

Due to the very high operating temperatures of the ceramic heating elements novel-type thermal insulating systems need to be employed such as multilayer systems with an under-insulation of an advanced composite plus an additional high-temperature layer facing the heating element or composites compacted in a single operation differing in formulation % and materials as well as a coating of ceramic material having a correspond sinter point or a flame or plasma coating of ceramic, yet another alternative being a reflector shield e.g. of die-cast $Al_2O_3$ foil.

The advantage of nanoscale carbon as a sinter additive lies substantially in the fact that due to the homogenous distribution of the carbon in the green bodies uniform compacting is achieved, resulting in sintered bodies with a uniform distribution of pores in a pore size range totalling 1 to 5 $\mu$m and 1.5 to 2 $\mu$m on an average. These pores should not be confused with those as mentioned before is describing the foamed ceramic. The fine pore necks at the surface of the sinter bodies can be closed by oxidation to thus form a self-protection mechanism of the ceramic body. Due to the fine porosity and the thus small diffusion distances such SiC qualities can be doped with nitrogen at temperatures of around 2,200° C. in a nitrogenous atmosphere by annealing subsequent to sintering. Via the duration of subsequent annealing in such a process the amount of nitrogen absorbed and thus the electric conductivity of the finished material can be set, meaning that the longer the duration the more nitrogen is absorbed.

What is claimed is:

1. An electric heating element for an electric radiant heater, said heating element comprising:

a semiconducting ceramic material, wherein material includes a foamed or skeletonized ceramic; and wherein said material at least partially comprises cavitations having a porosity between approximately 10 to 50 pores per inch.

2. The heating element as set forth in claim 1, wherein said porosity is approximately 30 pores per inch.

3. The electric heating element as set forth in claim 1, wherein said heating element comprises silicon.

4. The electric heating element as set forth in claim 3, wherein said heating element comprises silicon carbide.

5. The electric heating element as set forth in claim 1, wherein said heating element is at least partially rod-shaped.

6. The electric heating element as set forth in claim 1, wherein said structured ceramic is silicon-infiltrated.

7. The electric heating element as set forth in claim 1, wherein said heating element contains TiN.

8. The electric heating element as set forth in claim 7 wherein said TiN material is covered outwardly by a protective coating.

9. The electric heating element as set forth in claim 8 wherein said protective coating is an oxide film.

10. The electric heating element as set forth in claim 7 wherein said TiN is applied to a substrate.

11. The electric heating element as set forth in claim 7 wherein said TiN is admixed in a substrate material.

12. The electric heating element as set forth in claim 10 wherein $Al_2O_3$ is used as said substrate material.

13. The electric heating element as set forth in claim 10, wherein said heating element is fabricated substantially as a sandwich structure; and wherein a layer of said TiN is applied to a substrate with a protective coating covering said TiN layer.

14. The electric heating element as set forth in claim 13 wherein said sandwich structure is sheet-type.

15. The electric heating element as set forth in claim 1, wherein the effective heating cross-section of said heating element is adjustable via said porosity of said structured ceramic.

16. The electric heating element as set forth in claim 15, wherein the electrical resistance of said heating element is adjustable via said porosity.

17. The electric heating element as set forth in claim 1, wherein said heating element is a skeletonized open structure ceramic including branchings which each interconnect in three directions, and said cavitations between said branchings are larger than said branchings.

18. The electric heating element as set forth in claim 17 wherein in the course of elongation of said heating element the effective cross-section of said heating element remains substantially the same.

19. The electric heating element as set forth in claim 1 wherein the temperature coefficient of said ceramic material does not change in sign as viewed over the operating temperature range.

20. The electric heating element as set forth in claim 19 wherein said temperature coefficient has a PTC characteristic.

21. A method of producing an electric heating element having a semiconducting ceramic, said method comprising the steps of:

a) admixing a non-ceramic filler material in said ceramic starting material; and b) sintering said ceramic, wherein said filler material either acts as an insulator or is incinerated in said sintering step, producing insulating interspaces in said ceramic.

22. The method as set forth in claim 21 wherein said filler material are filler bodies and said filler bodies consist of a material which is dissolved in sintering.

23. The method as set forth in claim 22 wherein said filler material is a plastics material.

24. The method as set forth in claim 21 wherein said filler material are filler bodies and said filler bodies are admixed in said ceramic starting material substantially homogenously.

25. The method as set forth in claim 21 wherein said filler material is a substrate in the form of a textile material comprised of threads;

wherein said substrate is configured substantially three-dimensionally and is impregnated with said ceramic starting material;

wherein said textile material incinerates when said ceramic sinters; and wherein thin interconnected ceramic branchings are formed along said incinterated thread after sintering of said ceramic.

26. The method as set forth in claim 25 further comprising the step of molding said heating element still to be sintered.

27. The method as set forth in claim 26 wherein said molding step is undertaken after impregnating said textile material with ceramic starting material prior to sintering said starting material.

28. The method as set forth in claim 25 wherein on such a three-dimensionally structured substrate material TiN is applied as the electrically active material which is subsequently covered by a protective coating.

29. The method as set forth in claim 25 wherein after sintering, said ceramic is subsequently annealed and doped, said ceramic starting material containing nanoparticles by which doping with a dopant is made possible, particles from the atmosphere used in said subsequent annealing process diffusing into said ceramic during said doping procedure.

30. The method as set forth in claim 29 wherein via the duration of subsequent annealing the absorption of said dopant and thus the electrical resistance of said ceramic is adjustable.

31. An electric heating means including an electric heating element as set forth in claim 1, said heating element consisting of a structured ceramic and said heating means comprising a temperature sentinel assigned to said heating element, said temperature sentinel including control means for influencing said heating element.

32. An electric heating element consisting of semiconducting ceramic wherein said heating element comprises a negative temperature coefficient of its electrical resistance.

33. The electric heating element as set forth in claim 32 wherein said temperature coefficient is negative throughout as viewed over the operating temperature range.

34. The electric heating element as set forth in claim 32 wherein said heating element contains silicon.

35. The electric heating element as set forth in claim 34 wherein said material of said heating element contains silicon carbide.

36. The electric heating element as set forth in claim 32 wherein said heating element is elongated.

37. The electric heating element as set forth in claim 36 wherein said heating element is flat.

38. A method of producing an electric heating element having an inherently negative temperature coefficient of said electrical resistance, and consisting of a semiconducting ceramic, the method comprising the steps of:

doping a semiconducting ceramic starting material with a dopant for attenuating said negative temperature coefficient; and sintering said doped semiconducting ceramic, wherein naniparticles are contained in said starting materials by means of which the residual porosity of said ceramic is adjustable after the sintering process of said starting material.

39. The method as set forth in claim 38, further comprising compacting said starting material, wherein said starting material contains a binder and the porosity of said ceramic materializes in the sintering process.

40. The method as set forth in claim 39, wherein said starting material is non-compressively compacted to a relative density of 80% to 95%.

41. The method as set forth in claim 38 wherein after said sintering process said ceramic is subsequently annealed and particles from the atmosphere used in said subsequent annealing process diffuse into said ceramic during said doping procedure, the absorption of said particles in said ceramic and thus said electrical resistance of said ceramic being adjustable via the duration of said subsequent annealing.

* * * * *